US010029154B2

(12) United States Patent
Lin

(10) Patent No.: US 10,029,154 B2
(45) Date of Patent: Jul. 24, 2018

(54) TYPE TWO-LAYER LEAK-PROOF BALL AND MANUFACTURING METHOD THEREOF

(75) Inventor: Chun-Nan Lin, Taipei (TW)

(73) Assignee: Russell Brands, LLC, Bowling Green, KY (US)

( * ) Notice: Subject to any disclaimer, the term of this patent is extended or adjusted under 35 U.S.C. 154(b) by 1338 days.

(21) Appl. No.: 14/007,389

(22) PCT Filed: Feb. 29, 2012

(86) PCT No.: PCT/CN2012/071785
§ 371 (c)(1),
(2), (4) Date: Nov. 11, 2013

(87) PCT Pub. No.: WO2012/130011
PCT Pub. Date: Oct. 4, 2012

(65) Prior Publication Data

US 2014/0087900 A1 Mar. 27, 2014

(30) Foreign Application Priority Data

Mar. 25, 2011 (CN) ..... 2011 2 0092709 U

(51) Int. Cl.
*A63B 45/00* (2006.01)
*A63B 41/10* (2006.01)
*A63B 41/02* (2006.01)

(52) U.S. Cl.
CPC ..... *A63B 41/10* (2013.01); *A63B 41/02* (2013.01); *A63B 45/00* (2013.01); *A63B 2209/00* (2013.01)

(58) Field of Classification Search
CPC ..... A63B 41/10; A63B 45/00; A63B 41/02; A63B 2209/00
See application file for complete search history.

(56) References Cited

U.S. PATENT DOCUMENTS 4,462,590 A * 7/1984 Mitchell ..... A63B 41/08 273/DIG. 8
4,513,058 A * 4/1985 Martin ..... A63B 41/02 427/379

(Continued)

FOREIGN PATENT DOCUMENTS

CN 201064644 Y * 5/2008
CN 202015459 U * 10/2011 ..... A63B 41/02

OTHER PUBLICATIONS

"Ball Doctor Sealant—One Quart with Syringe (Repairs about 30 Balls)", ,http://www.onlinesports.com/pages/I,OLY-BA821P-3.html>, retrieved on Jul. 12, 2005.*

(Continued)

*Primary Examiner* — Steven Wong
(74) *Attorney, Agent, or Firm* — Bradley Arant Boult Cummings LLP; Jacob Neu; Nathan Johnson

(57) ABSTRACT

A two-layer leak-proof ball comprises a sheath layer (1), an intermediate body layer (2), a winding yarn layer (3), an inner body layer (4) and a two-layer protective layer (5). The intermediate body layer (2), the winding yarn layer (3), the inner body layer (4) and the two-layer protective layer (5) are tightly set successively at the inside of the sheath layer (1). Also disclosed is the manufacturing method of the two-layer protective layer (5) of the two-layer leak-proof ball. High air-sealed bromide butyl mucilage is injected at the inside of the inner body layer (4), and vulcanized at low temperature, thus a glue film is formed at the inner wall of the inner body layer (4). The inner bag of the two-layer leak-proof ball has high tightness and long service life.

6 Claims, 1 Drawing Sheet

(56) References Cited

U.S. PATENT DOCUMENTS 4,660,831 A * 4/1987 Kralik ..... A63B 41/00 473/603
5,026,054 A * 6/1991 Osher ..... A63B 37/06 273/DIG. 20
5,096,756 A * 3/1992 Walters ..... A63B 41/02 273/DIG. 5
5,503,940 A * 4/1996 Majumdar ..... C08K 5/3415 152/565
5,545,451 A * 8/1996 Haung ..... B29C 41/14 2/159
5,713,141 A * 2/1998 Mitchell ..... A43B 13/203 36/29
5,741,195 A * 4/1998 Sullivan ..... A63B 43/06 473/570
5,992,486 A * 11/1999 Katsuki ..... B60C 1/0008 152/510
6,206,795 B1 * 3/2001 Ou ..... A63B 41/08 473/599
6,544,608 B1 * 4/2003 Jain ..... A63B 41/02 264/305
6,620,472 B1 * 9/2003 Shepard ..... B32B 27/08 210/490
8,123,639 B2 * 2/2012 Magon ..... A63B 41/02 428/35.7
2003/0171173 A1 * 9/2003 Rudzki ..... A63B 41/00 473/569
2006/0293132 A1 * 12/2006 Laliberty ..... A63B 41/00 473/603
2008/0044635 A1 * 2/2008 O'Neill et al. ..... A63B 41/02 428/212
2009/0000718 A1 * 1/2009 Rouckhout ..... B60C 1/0008 152/511
2009/0069122 A1 * 3/2009 Laliberty ..... A63B 41/08 473/415
2009/0325744 A1 * 12/2009 Raynak ..... A63B 41/085 473/604
2010/0200139 A1 * 8/2010 Beers ..... B60C 1/0008 152/510
2012/0101193 A1 * 4/2012 Sandstrom ..... C08L 23/22 524/15
2012/0329587 A1 * 12/2012 Ou ..... A63B 41/08 473/605
2014/0080643 A1 * 3/2014 Lin ..... A63B 37/06 473/598
2014/0100067 A1 * 4/2014 Swiszcz ..... A63B 41/08 473/603
2014/0179468 A1 * 6/2014 Berggren ..... A63B 41/08 473/604

OTHER PUBLICATIONS

"Flat Proof Puncture Selaant", <http://www.onlinesports.com/pp./I,OLY-BA 106P-3.html> retrieved on Jul. 12, 2005.*

* cited by examiner

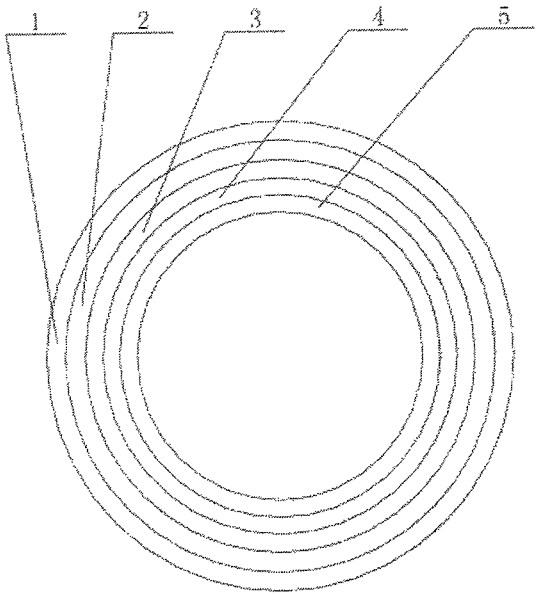
1
2
3
4
5

TYPE TWO-LAYER LEAK-PROOF BALL AND MANUFACTURING METHOD THEREOF

TECHNICAL FIELD

The present invention relates to the technical field of sports goods and supplies. In particular, it relates to a new type of dual-layer leak-proof ball.

BACKGROUND ART

The ball-related sports have covered a wide variety of body physical exercising forms, including running, jumping and throwing etc. In addition, they have a relatively high exercising intensity. Therefore, they can promote physical fitness and overall developments of the human body functions in a comprehensive, effective and integrated manner, improve and maintain people's vitality, and provide a solid body (substance) basis for all different types of human activities. Hence they will improve people's living quality. There are many different balls available on the market, so it is very important to choose a high quality ball. This is so that when in use, a person may feel quite comfortable when grabbing a high quality ball. Moreover, a ball with stable bouncing and rotating performance would be helpful for developing good dribbling habits, as well as to perform standard technical abilities well. A ball of excellent quality can also enhance its user's self-confidence, improve the quality of training and bring more fun to the exercises. Further, a high quality ball will have a longer service life.

The sports ball can be divided into rubber (plastic) balls, hand-sewn or machine-sewn balls, and laminated balls. The most commonly used ball is the laminated basketball. It is comprised of an inner body layer, a sheath layer, a ball opening and so on. The inner body layer is the inner ball bladder, which is the heart of the ball and located at the innermost layer of the ball. It is made of black-colored rubber. The quality of air tightness of the inner bladder determines the service life of the ball. Although the air tightness quality of the traditional ball is fairly good, it is still prone to leaks following a long period of use. Document U.S. Pat. No. 2,623,747 describes an inflatable athletic ball.

SUMMARY OF INVENTION

The objective of the present invention is to provide a new type of dual-layer leak-proof ball. It can improve the service life of the ball. The protective layer can ensure the inner body is air-tight.

In order to solve the problems in the prior art, the present invention employs the following technical solution: it comprises a sheath layer, an intermediate body layer, a winding yarn layer, an inner body layer and a protective layer; the intermediate body layer, the winding yarn layer, the inner body layer and the protective layer are tightly set successively within the sheath layer.

Said protective layer is made of air-sealing bromobutyl mucilage.

The embodiment has added a layer of high air-sealed bromobutyl material within the inner body layer, so that it provides a protective layer to ensure the inner body is air tight and to improve the service life of the ball. In addition, its manufacturing process is fairly simple.

BRIEF DESCRIPTION OF THE DRAWINGS

FIG. 1 is a cross-sectional structural view of the present invention.

DESCRIPTION OF EMBODIMENT

With reference to FIG. 1, the current embodiment has employed the following technical solution: it comprises a sheath layer 1, an intermediate body layer 2, a winding yarn layer 3, an inner body layer 4 and a protective layer 5; the intermediate body layer 2, the winding yarn layer 3, the inner body layer 4 and the protective layer 5 are tightly set successively within the inside of the sheath layer 1.

The approach is to inject the high air-sealed bromobutyl mucilage (protective layer 5) into the inside of the inner body layer 4, make it evenly distributed on the inside of the inner body layer 4, and then dry it through low temperature vulcanization at 40-60° C. (by baking in an oven), vulcanizing it to form a film that is tightly connected to the inner body layer 4, to carry out a reinforcing effect on the inner body layer 4. The winding yarn layer 3 is tightly disposed along the outside of the inner body layer 4. The intermediate body layer 2 is tightly disposed at the outside of the winding yarn layer 3. The sheath layer 1 is disposed at the outside The method of manufacturing the protective layer 5 of the present invention is as follows: injecting the high air-sealed bromobutyl mucilage into the inside of the inner body layer 4. Said bromobutyl mucilage comprises the materials with the following weight part ratios: 40-60 parts of rubber which comprises bromobutyl rubber with a weight percentage of 80-100%, and natural rubber with a weight percentage of 0-20%; 40-60 parts of ultra-fine-sized carbon black as a reinforcing agent, having a particle size of 325 mesh sieve residue ≤0.1%; and 1-5 parts of rubber vulcanization hardener. Said high air-sealed bromobutyl mucilage is injected into the inside of the inner body layer 4. With a method similar to the high speed rotation of a large rotating lottery machine, performed over a period of 20-30 minutes to allow free bouncing and rotating (such lottery machines being in prior art), such that the bromobutyl mucilage is evenly distributed along the inner surface of the inner body layer 4. In this way, it is made to fill and reinforce the inner wall of the inner body, and to tightly adhere to the inner surface of the inner body. After injecting the above-mentioned materials with the weight part ratios forming the bromobutyl mucilage, the inner body layer 4 is baked in an oven of 40-60° C. to vulcanize at low temperature. Vulcanization lasts for 12 hours, to ensure the vulcanized mucilage film has a high level of air tightness, so as to perform the reinforcement and dual-layer protection effects for the inner body, to further improve and ensure the air tightness quality of the inner body, and thus increase the service life of the ball.

Embodiment 1

The high air-sealed bromobutyl mucilage (protective layer 5) is injected into the inside of the inner body layer 4. Said bromobutyl mucilage comprises the materials of the following weight part ratios: 50 parts of rubber, comprising bromobutyl rubber with a weight percentage of 80% and natural rubber with a weight percentage of 20%; 45 parts of carbon black of ultra-fine size as a reinforcing agent, having particle size of at least: 325 mesh sieve residue ≤0.1%; and 5 parts of rubber hardener. Said high air-sealed bromobutyl mucilage is injected into the inside of the inner body layer 4. With a method similar to the high speed rotation of a large rotating lottery machine, performed over a period of 20 minutes to allow free bouncing and rotating, such that the bromobutyl mucilage is evenly distributed along the inner surface of the inner body layer 4. In this way, it is made to refill and reinforce the inner wall of the inner body, and to tightly adhere to the inner surface of the inner body. After injecting the above-mentioned materials with the weight part ratios to form the bromobutyl mucilage, the inner body layer 4 is baked in an oven of 40-60° C. to vulcanize at low temperature. Vulcanization lasts for 12 hours, to ensure the vulcanized mucilage film has a high level of air tightness.

Embodiment 2

The high air-sealed bromobutyl mucilage is injected into the inside of the inner body layer 4. Said bromobutyl mucilage comprises the materials of the following weight part ratios: 50 parts of rubber comprising bromobutyl rubber with a weight percentage of 100%; 45 parts of carbon black of ultra-fine size as a reinforcing agent, having a particle size at least: 325 mesh sieve residue ≤0.1%; and 5 parts of rubber hardener. Said high air-sealed bromobutyl mucilage is injected into the inside of the inner body layer 4. With a method similar to the high speed rotation of a large rotating lottery machine, performed over a period of 30 minutes to allow free bouncing and rotating, such that the bromobutyl mucilage is evenly distributed along the inner surface of the inner body layer 4. In this way, it is made to refill and reinforce the inner wall of the inner body, and to tightly adhere to the inner surface of the inner body. After injecting the above-mentioned materials with the weight part ratios to form the bromobutyl mucilage, the inner body layer 4 is baked in an oven of 40-60° C. to vulcanize at low temperature. Vulcanization lasts for 12 hours, to ensure the vulcanized mucilage film has a high level of air tightness.

Embodiment 3

The high air-sealed bromobutyl mucilage is injected into the inside of the inner body layer 4. Said bromobutyl mucilage comprises the materials of the following weight part ratios: 50 parts of rubber comprising bromobutyl rubber with a weight percentage of 90% and natural rubber with a weight percentage of 10%; 45 parts of carbon black of ultra-fine size as a reinforcing agent, whose particle size is at least: 325 mesh sieve residue ≤0.1%; and 5 parts of rubber hardener. Said high air-sealed bromobutyl mucilage is injected into the inside of the inner body layer 4. With a method similar to the high speed rotation of a large rotating lottery machine, performed over a period of 25 minutes to allow free bouncing and rotating, such that the bromobutyl mucilage is evenly distributed along the inner surface of the inner body layer 4. In this way, it is made to refill and reinforce the inner wall of the inner body, and to tightly adhere to the inner surface of the inner body. After injecting the above-mentioned materials with the weight part ratios to form the bromobutyl mucilage, the inner body layer 4 is baked in an oven of 40-60° C. to vulcanize at low temperature. Vulcanization lasts for 12 hours, to ensure the vulcanized mucilage film has a high level of air tightness.

Embodiment 4

The high air-sealed bromobutyl mucilage is injected into the inside of the inner body layer 4. Said bromobutyl mucilage comprises the materials of the following weight part ratios: 50 parts of rubber comprising bromobutyl rubber with a weight percentage of 80% and natural rubber with a weight percentage of 20%; 49 parts of carbon black of ultra-fine size as a reinforcing agent, having a particle size at least: 325 mesh sieve residue ≤0.1%; and 1 part of rubber hardener. Said high air-sealed bromobutyl mucilage is injected into the inside of the inner body layer 4. With a method similar to the high speed rotation of a large rotating lottery machine, performed over a period of 25 minutes to allow free bouncing and rotating, such that the bromobutyl mucilage is evenly distributed along the inner surface of the inner body layer 4. In this way, it is made to refill and reinforce the inner wall of the inner body, and to tightly adhere to the inner surface of the inner body. After injecting the above-mentioned materials with the weight part ratios to form the bromobutyl mucilage, the inner body layer 4 is baked in an oven of 40-60° C. to vulcanize at low temperature. Vulcanization lasts for 12 hours, to ensure the vulcanized mucilage film has a high level of air tightness.

Embodiment 5

The high air-sealed bromobutyl mucilage is injected into the inside of the inner body layer 4. Said bromobutyl mucilage comprises the materials of the following weight part ratios: 50 parts of rubber comprising bromobutyl rubber with a weight percentage of 90% and natural rubber with a weight percentage of 10%; 48 parts of carbon black of ultra-fine size as the reinforcing agent, having a particle size at least: 325 mesh sieve residue ≤0.1%; and 2 parts of rubber hardener; and injecting said high air-sealed bromobutyl mucilage into the inside of the inner body layer 4. With a method similar to the high speed rotation of a large rotating lottery machine, performed over a period of 20 minutes to allow free bouncing and rotating, such that the bromobutyl mucilage is evenly distributed along the inner surface of the inner body layer 4. In this way, it is made to refill and reinforce the inner wall of the inner body, and to tightly adhere to the inner surface of the inner body. After injecting the above-mentioned materials with the weight part ratios to form the bromobutyl mucilage, the inner body layer 4 is baked in an oven of 40-60° C. to vulcanize at low temperature. Vulcanization lasts for 12 hours, to ensure the vulcanized mucilage film has a high level of air tightness.

The invention claimed is:

1. A method of manufacturing a leak-proof ball, comprising: injecting an air-sealing bromobutyl mucilage into the interior of an inner body layer, said bromobutyl mucilage comprising materials of the following weight part ratios: 40-60 parts of rubber comprising bromobutyl rubber with a weight percentage of 80-100% and natural rubber with a weight percentage of 0-20% 40-60 parts of carbon black of ultra-fine size, having a particle size at least: 325 mesh sieve residue ≤0.1%; and 1-5 parts of rubber hardener; distributing the bromobutyl mucilage on the inner wall of the inner body layer, such that the mucilage reinforces the inner wall of the inner body and is tightly adhered to the inner surface of the inner body by freely rotating and bouncing the ball for 20-30 minutes; and baking the inner body layer for 12 hours in an oven of 40-60° C.

2. The method of claim 1, wherein the bromobutyl mucilage comprises materials of the following weight part ratios: 50 parts of rubber comprising bromobutyl rubber with a weight percentage of 80% and natural rubber with a weight percentage of 20%; 45 parts of carbon black of ultra-fine size, having a particle size at least: 325 mesh sieve residue ≤0.1%; and 5 parts of rubber hardener; and wherein the period of time for freely bouncing and rotating the ball is 20 minutes.

3. The method of claim 1, wherein the bromobutyl mucilage comprises materials of the following weight part ratios: 50 parts of rubber comprising bromobutyl rubber with a weight percentage of 100%; 45 parts of carbon black of ultra-fine size, having a particle size at least: 325 mesh sieve residue ≤0.1%; and 5 parts of rubber hardener; and wherein the period of time for freely bouncing and rotating the ball is 30 minutes.

4. The method of claim 1, wherein the bromobutyl mucilage comprises materials of the following weight part ratios: 50 parts of rubber comprising bromobutyl rubber with a weight percentage of 90% and natural rubber with a weight percentage of 10%; 45 parts of carbon black of ultra-fine size, having a particle size at least: 325 mesh sieve residue ≤0.1%; and 5 parts of rubber hardener; and wherein the period of time for freely bouncing and rotating the ball is 25 minutes.

5. The method of claim 1, wherein the bromobutyl mucilage comprises materials of the following weight part ratios: 50 parts of rubber comprising bromobutyl rubber with a weight percentage of 80% and natural rubber with a weight percentage of 20%; 49 parts of carbon black of ultra-fine size, having a particle size at least: 325 mesh sieve residue ≤0.1%; and 1 parts of rubber hardener; and wherein the period of time for freely bouncing and rotating the ball is 25 minutes.

6. The method of claim 1, wherein the bromobutyl mucilage comprises materials of the following weight part ratios: 50 parts of rubber comprising bromobutyl rubber with a weight percentage of 90% and natural rubber with a weight percentage of 10%; 48 parts of carbon black of ultra-fine size, having a particle size at least: 325 mesh sieve residue ≤0.1%; and 2 parts of rubber hardener; and wherein the period of time for freely bouncing and rotating the ball is 20 minutes.

* * * * *